United States Patent [19]

Graillat

[11] Patent Number: 4,925,206

[45] Date of Patent: May 15, 1990

[54] CROSS-COUNTRY SKI BINDING

[75] Inventor: Gerard Graillat, Annecy, France

[73] Assignee: Salomon S.A., Annecy Cedex, France

[21] Appl. No.: 232,106

[22] Filed: Aug. 15, 1988

[30] Foreign Application Priority Data

Aug. 26, 1987 [FR] France ..... 87 11953

[51] Int. Cl.[5] ..... A63C 9/086

[52] U.S. Cl. ..... 280/615; 280/607

[58] Field of Search ..... 280/615, 614, 631, 618, 280/607

[56] References Cited

U.S. PATENT DOCUMENTS

| | | | |
|---|---|---|---|
| 4,533,154 | 8/1985 | Bernard et al. | 280/615 |
| 4,682,785 | 7/1987 | Jungkind | 280/615 |
| 4,722,613 | 2/1988 | Jungkind | 280/615 |
| 4,735,433 | 4/1988 | Corbet et al. | 280/615 |

FOREIGN PATENT DOCUMENTS

| | | | |
|---|---|---|---|
| 183000 | 6/1986 | European Pat. Off. | 280/615 |
| 0231731 | 8/1987 | European Pat. Off. . | |
| 3612658 | 11/1986 | Fed. Rep. of Germany . | |
| 3744192 | 7/1988 | Fed. Rep. of Germany | 280/615 |
| 2582226 | 11/1986 | France . | |
| 8503643 | 8/1985 | World Int. Prop. O. . | |

*Primary Examiner*—David M. Mitchell

*Attorney, Agent, or Firm*—Sandler, Greenblum & Bernstein

[57] ABSTRACT

A cross-country ski binding having a linkage element for pivotal mounting relative to a ski about a first axis; a latching element pivotally connected to the linkage element about a second axis between a retention position, for retaining a boot to the binding, and a release position, for permitting the boot to be removed from the binding; a device for biasing the latching element toward the retention position, wherein the biasing device is connected between the latching member and a member fixed with respect to the ski. The biasing device is compressed in a direction that is offset with respect to both the first and second axes. The binding according to the invention omits the use of a stirrup member which is used in particular known ski bindings.

41 Claims, 6 Drawing Sheets

CROSS-COUNTRY SKI BINDING

BACKGROUND OF THE INVENTION

1. Field of the Invention

The present invention relates to improvements a cross-country ski bindings.

2. Discussion of Background and Relevant Information

The present invention relates to improvements in cross-country ski bindings described in the first Certificate of Addition of French No. 87 07932, filed June 5, 1987, which corresponds to commonly assigned application U.S. Ser. No. 07/153,457, filed Feb. 8, 1988, which is herein incorporated by reference. The cross-country binding disclosed therein is adapted to assure the linkage between a front zone of a cross-country ski boot or shoe and a cross-country ski and includes: at least one support element; one linkage element swivel-mounted on the support element, around a first transverse axis; an abutment for limiting the rotation of the linkage element in a first predetermined direction around the first axis with respect to the support element in a manner so as to define a preferred angular position of the linkage element with respect with the support element, the first direction being oriented from front to rear above the first axis; a latching element of a front boot zone being swivel-mounted on the linkage element, around a second transverse axis, between a retention position and a release position of the front zone of the boot, the passage from the release position to the retention position occurring by rotation of the latching element in a second predetermined direction around the second axis, with respect to the linkage element, the second direction being oriented from front to rear above the second axis; at least one journal surface extending around a third transverse axis, from the front zone of the boot with respect to the support element and/or linkage element by nesting and movable support of the front zone of the boot with respect to the support element and/or the linkage element in a radial direction with respect to the third axis, the movable journal surface facing upstream with reference to the radial direction with reference to the second direction; at least one support zone of the latching element, in the retention position, on the front zone of the boot opposite the third axis with respect to the said front zone of the boot in the radial direction, the support zone of the latching element being offset with respect to the second axis and facing downstream with reference to the second direction and being positioned such that it is likewise facing downstream with reference to the radial direction in the retention position and releases the front zone of the boot upstream with reference to the radial direction in the release position; and an elastic bias mechanism of the latching element in the second direction and of the linkage element in the first direction.

In this known binding, the elastic bias mechanism acts, in elastic compression, between the support element and a stirrup which is swivel-mounted on the linkage element but is immobilized with respect thereto when the latching element occupies its retention position, by support on this latching element itself supported on the front zone of the boot itself supported towards the third transverse axis, which is coincident with the first transverse axis, with respect to the support element and to the linkage element. As a result of this immobilization of the stirrup with respect to the linkage element there occurs the elastic bias of the latter in the first direction, while the elastic bias of the latching element in the second direction results directly from the action of the stirrup on the latching element under the action of the elastic bias mechanism.

This known binding is functionally satisfactory, but it has the disadvantage of including three movable elements, besides the elastic bias mechanism, namely, the linkage element, the support element and the stirrup. Further, the shape and mounting of the stirrup on the other elements is complex and costly.

SUMMARY OF THE INVENTION

An object of the present invention is to overcome the aforementioned disadvantages to provide a cross-country binding adapted to assure the linkage between a front portion of a cross-country ski boot and a cross-country ski including at least one support element; a linkage element swivel-mounted on the support element around a first axis and limiting rotation of the linkage element in a first predetermined direction around the first axis with respect to the support element in a manner as so to define a preferred angular position of the linkage element with respect to the support element, the first direction being oriented from front to rear above the first axis; a latching element swivel-mounted on the linkage element around a second transverse axis between, respectively, a retention position and a release position with respect to a front portion of the ski boot, movement from the release position to the retention position occurring by rotation of the latching element in a second predetermined direction around the second axis with respect to the linkage element, the second direction being oriented from front to rear above the second axis; at least one journal surface extending around a third axis for supporting the front portion of the ski boot, with respect to the support element and/or the linkage element by supporting the front portion of the ski boot, with respect to the support element, and/or the linkage element in a radial direction with respect to the third axis, the at least one journal surface facing upwardly with reference to the radial direction and with reference to the second direction; at least one support zone of the latching element for supporting, in the retention position, the front portion of the ski boot opposite the third axis with respect to the front portion of the ski boot in the radial direction, the support zone of the latching element being offset with respect to the second axis and facing in the second direction and being positioned such that it likewise faces in the radial direction in the retention position and is removed from the front portion of the ski boot upwardly, with reference to the radial direction in the release position; and a device for elastically biasing the latching element in the second direction and the linkage element in the first direction; wherein the elastically biasing device includes at least one element which is elastically compressible along a predetermined direction and is supported in compression along this direction on a zone of the support element, offset with respect to the first axis and is supported on the zone of the latching element, offset with respect to the second axis.

The support element according to the invention can be partially or totally constituted by the ski to which the binding is attached.

According to another aspect of the invention, the support zone of the latching element is positioned in the vicinity and in the rear of a geometrical plane through the second and third axes and between the second and third axes, in the retention position.

According to another aspect of the invention, the journal surface is convex for cooperation with a concave surface of the front portion of the ski boot.

According to another aspect of the invention, the zone of the support element is situated in front of the first axis and the zone of the latching element is positioned in front of the second axis when the linkage element occupies the second preferred angular position and the latching element occupies the retention position.

In still another aspect of the invention, the latching element and the linkage element include portions for limiting rotation of the latching element in the second direction around the second axis, with respect to the linkage element in a manner so as to define a limiting angular position of the latching element with respect to the linkage element, the limiting angular position being close to the retention position, but offset towards the second direction.

In still another aspect of the invention, the latching element and the linkage element includes portions for limiting rotation of the latching element in the second direction, around the second axis, with respect to the linkage element, the limiting angular position corresponding to the retention position.

In still another aspect of the invention, the latching element has a surface for voluntary application of pressure in a direction opposite to the second direction, the pressure application surface facing upwardly with reference to the second direction and upwardly when the linkage element occupies the preferred angular position and the latching element occupies the retention position.

In a further aspect of the invention, the latching element includes at least one zone for biasing the front portion of the ski boot in a direction opposite to the second direction during movement from the retention position to the release position.

In a further aspect of the invention, the latching element includes two wings spaced along the first axis and the second axis such that the front portion of the ski boot can be inserted between the wings and the latching element can be positioned between the wings.

In respective alternative embodiments of the invention, the first axis and the third axis can be substantially coincident, or the third axis can be offset with respect to the first axis and with respect to the support element, or the third axis can be offset with respect to the first axis and fixed with respect to the linkage element.

In a still further aspect of the invention, the support zone of the latching element is a convex projection for cooperation with a transverse concave seat of the front portion of the ski boot.

In a still further aspect of the invention, the support zone of the latching element is a transverse edge for cooperation with the front portion of the ski boot.

It is a further object of the invention to provide a ski binding that includes a linkage element for pivotal mounting relative to a ski about a first axis; a latching element pivotally connected to the linkage element about a second axis between a retention position, for retaining a boot to the binding, and a release position, for permitting the boot to be removed from the binding; means separate from the latching element for supporting at least a portion of the boot when the latching element is in the retention position; a device for biasing the latching element toward the retention position, the biasing device being supported by means fixed to the means for supporting at least a portion of the boot and by the latching element.

According to the invention, during operation of the binding, the device for biasing the latching element is elastically compressible along a predetermined direction offset from the first axis and from the second axis.

In another aspect of the invention, when the binding is mounted upon a ski, the device for biasing the latching element is supported by the means fixed to the means for supporting at least a portion of the boot forwardly of the first axis, and is supported by the latching element forwardly of the second axis.

In another aspect of the invention, the biasing device biases the linkage element toward a preferred position and the binding includes means for limiting the linkage element from rotation rearwardly beyond the preferred position and, preferably, is carried by the linkage element.

In another aspect of the invention, the means for supporting at least a portion of the boot includes a journal surface extending around a predetermined axis and for supporting the boot for rotation about the predetermined axis when the ski boot is mounted to the binding.

In a further aspect of the invention, the first axis and the predetermined axis are substantially coextensive or, alternatively, the predetermined axis is not coextensive with the first axis and the journal surface is carried by the linkage element or, alternatively, the predetermined axis is not coextensive with the first axis and the journal surface is adapted to be fixed relative to the ski.

In a further aspect of the invention, the latching element includes a support zone opposite the journal surface for supporting the portion of the boot, wherein the support zone is rearward of a plane passing through the second axis and the predetermined axis.

In a further aspect of the invention, the means for supporting a portion of the boot preferably includes a support element having a longitudinal concavity for mating with an upwardly projecting longitudinal ski rib.

In a further aspect of the invention, the linkage element includes a pair of wings and the support element includes a pair of swivels extending between a respective wing and a lateral side of the support element. Further, a respective sleeve preferably surround each of the swivels for providing a support surface for the front portion of the boot.

Other characteristics and advantages of the present invention will become clear from the description below, relating to three non-limited embodiments, as well as the accompanying drawings which form an integral portion of this description.

DETAILED DESCRIPTION OF PREFERRED EMBODIMENTS

Figure 1:
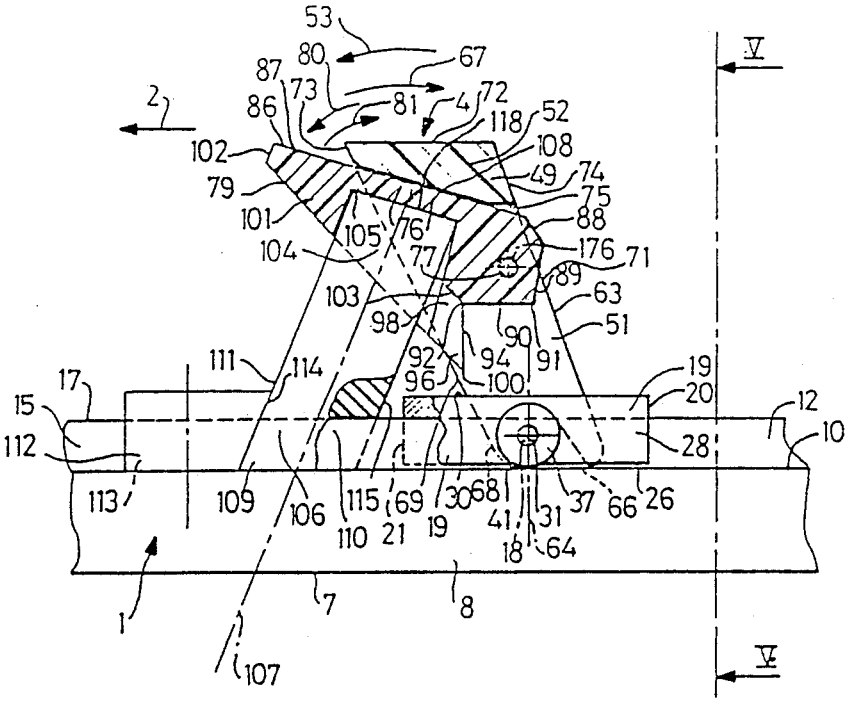
FIG. 1 illustrates, in lateral elevation and partially in cross section through planes parallel to a longitudinal median plane of the ski, a first embodiment of the binding according to the invention in which the boot has been removed, the linkage element occupying the stable angular position and the latching element occupying the limiting angular position with respect to the linkage element, under the effect of the elastically compressible element constituting the elastic bias mechanism.

The cross-country ski binding of the present invention has a simplified construction with respect to the known cross-country ski binding described above. To this end, with respect to the known binding, the cross-country ski binding according to the invention is particularly characterized in that the elastic bias mechanism includes at least one elastic element which is compressible along a predetermined direction and being supported in compression, along the direction, on the one hand on a zone of the support element offset with respect to the first axis and, on the other hand, on a zone of the latching element offset with respect to the second axis.

In comparing the binding according to the invention with that of the binding described above, the absence of the stirrup is noted, i.e., the absence of the most complex element to construct and to assemble with the other elements. This results in a substantial simplification of the formation and mounting of the binding and in a reduction of its cost.

The binding according to the invention, however, offers complete security in the retention of the front zone of the cross-country boot with respect to the cross-country ski, and this security is further increased according to one preferred embodiment in which the support zone is positioned in the vicinity of and upstream from the second direction, to a geometrical plane including the second and third axes, between the second and third axes, in the retention position. In fact, there occurs in this position a self-blocking effect of the binding due to the fact that, When the boot pivots and is lifted from the support position flat on the ski, the linkage element and the latching element forming a complete assembly, this movement reinforces the support of the latching element on the front zone of the boot not only by virtue of an increase in compression of the elastically compressible element, but also for geometrical reasons which are easily understood by one of ordinary skill in the art.

Furthermore, to reinforce the retention of the front zone of the boot by the latching element, the support zone is preferably formed as a convex transverse surface for cooperation with a concave surface of the front zone of the boot or, further, a transverse edge. Likewise, the journal surface is preferably convex for cooperation with a concave surface of the front zone of the boot. These shapes contribute likewise to the stability of the boot, against lateral rotational movement with respect to the ski, which can translate in an escape of the front end of the boot with respect to the support element. To this end, likewise, the linkage element is preferably provided in the shape of a cap including two wings between the first and second axis, such that the front zone of the boot can be engaged between the wings, and that the latching element is positioned between the wings.

The linkage element and the latching element can be constructed of particularly simple shapes when, according to a preferred embodiment, the zone of the support element is positioned in front of the first axis and the zone of the latching element is positioned in front of the second axis when the linkage element occupies the preferred angular position and the latching element occupies the retention position.

Preferably, the latching element and the linkage element have stopping portions for limiting the rotation of the latching element in the second direction, around the second axis, with respect to the linkage element in a manner so as to define a limiting angular position of the latching element with respect to the linkage element, this limiting angular position being close to the retention position but offset downstream, with reference to the said second direction, with respect to it or, in the extreme case, coincident therewith. This arrangement makes it possible for the latching element to assume a stable position with respect to the linkage element when the binding is removed, i.e., in the absence of the front zone of the boot, which prevents the compressible elastic element acting on the latching element to bring the latching element with respect to the linkage element, into a position which renders manipulation of the binding difficult for insertion of the boot. Likewise, to facilitate the insertion of boot, the latching element preferably has a voluntary pressure application surface in the direction opposite to the second direction, the pressure application surface facing upwardly with reference to the second direction and upwardly when the linkage element occupies the preferred angular position and the latching element occupies the retention position.

The removal of the boot is facilitated when, as is preferred, the latching element has a bias zone in the front zone of the boot in the direction opposite to the second direction during passage from the retention position to the release position.

Numerous embodiments of a binding according to the invention are possible since one can, for example, provide that the third axis is coincident with the first axis, or that it is offset with respect to the first axis and fixed either with respect to the support element or with respect to the linkage element. Likewise, the support element can be at least partially, even totally, constituted by the ski just as it can be constituted at least partially, even totally, by one or more elements fixed relative to the ski.

In all of the figures, a central section of a ski 1 is illustrated resting flat on a horizontal surface, in a normal position of use and, respectively, in FIGS. 1–6, 7 and 8, and 9 and 10, there is designated by 4, 204, and 404, a binding according to the invention. In FIGS. 1–4, 7, and 9, there is designated by 2 a forward longitudinal direction of displacement of ski 1, this direction being horizontal in this example. In FIGS. 5, 6, 8, and 10 there is designated by 3 a longitudinal median plane, vertical in this example, which plane constitutes for the entire ski 1, as for the bindings 4, 204, and 404, a longitudinal plane of symmetry.

By convention, in the case of the three embodiments described by way of non-limiting examples, terms such as longitudinal, transverse, front, and rear will be understood to correspond to the longitudinal direction 2 and to the longitudinal median plane 3, and terms such as level, horizontal, upward, and downward will extend by reference to the position of the ski 1 illustrated in all of the figures, without, however, implying any limitation as to the position in which a binding according to the invention may be utilized.

In FIGS. 2, 3, 4, and 6, there has been illustrated a front end zone 6 of a boot 5, which front end zone 6 is or can be connected to the central illustrated section of ski 1 by means of the binding 4. In FIGS. 7, 8, 9 and 10, respectively, there have been illustrated respective front end zones 206 and 406 of boots 205 and 405 which front end zones 206 and 406 are connected to the central illustrated portion of ski 1, respectively, by means of binding 204 and binding 404.

In a known manner, and by way of non-limiting example, in its central illustrated section, ski 1 has a lower surface 7 which is substantially planar, horizontal and perpendicular to plane 3, two lateral sides 8 and 9, substantially planar and vertically symmetrical to one another with respect to the plane 3, and connected along the length of the ski by lower surface 7.

The sides 8 and 9 connect on top to respective longitudinal upper surface strips 10 and 11, which are substantially planar and parallel to the surface 7 and substantially symmetrical to one another with respect to longitudinal median plane 3 of the ski 1. Between and projecting above upper surface strips 10 and 11, ski 1 includes an upper longitudinal rib 12 affixed thereto and which, in a known manner either extends over the major portion of the length of the ski or is limited to an area of the ski adapted to receive the boot, in the immediate vicinity of the binding 4, 204, or 404. In a complementary fashion, boot 5, 205, 405, has a sole, 13, 213, 413, having a continuous longitudinal groove 14, 214, 414 cut out therein and adapted to mate with rib 12 to allow the boot 5, 205, 405 to occupy the position illustrated in FIGS. 3, 7, and 9, respectively, in which the sole 13, 213, 413 rests flat upon the strips 10 and 11 of ski 1, respectively, on each side of rib 12. Such a configuration is known and it would not be beyond the scope of the present invention to adopt another configuration, and to associate a binding according to the invention with a ski not having a longitudinal upper rib and having, as a result, a substantially smooth upper surface. One of ordinary skill in the art could modify, to this end, the bindings 4, 204, 404 which will be described without encountering difficulties and without going beyond the scope of the present invention.

In the example illustrated, rib 12 has a transverse trapezoidal cross-section which is symmetrical with respect to plane 3 and projects upwardly as illustrated in FIGS. 5, 6, 8, and 10. Specifically, it has two side surfaces 15 and 16 which, in the illustrated central section of ski 1, can be considered as substantially planar and converging upwardly, symmetrically with respect to the plane 3, respectively from upper surface strip 10 and from upper surface strip 11, to upper surface 17 of rib 12, which upper surface 17 is substantially perpendicular to plane 3 and substantially planar in the illustrated central section of ski 1. Of course, one would not go beyond the scope of the present invention by adopting another shape for the optional longitudinal upper rib of the ski and by adopting in an appropriate fashion the binding according to the invention.

The embodiment of this binding which is illustrated in FIGS. 1–6 and designated by reference 4 will now be described in greater detail.

In the case of this embodiment, the binding 4 according to the invention is adapted to assure the linkage between the front end zone 6 of boot 5 and ski 1 and to maintain this linkage during extensional movement of the foot, while allowing exclusively for rotation of boot 5 with respect to ski 1 around a transverse axis 18, i.e., substantially perpendicular to the longitudinal median plane 3 of ski 1. Axis 18 is fixed with respect to ski 1 and to boot 5 and is secant to rib 12, between the upper surface 17 thereof and the upper surface strips 10 and 11 of ski 1.

To this end, binding 4 preferably comprises a support element 19 which tightly overlaps rib 12 with which it is affixed for example by screws, in a manner not shown, or by gluing, or, further, by any other appropriate means. Support element 19 can be formed out of any rigid material. Respectively towards the rear and front, with reference to direction 2, support element 19 is defined by planar surfaces 20, 21 which are arranged symmetrically to one another with respect to the axis 18, perpendicularly to the longitudinal median plane 3 of the ski, and more precisely, verticallY in the position illustrated. Towards the bottom, to mate best with rib 12, support element 19 has a longitudinal channel 22 which has an inner substantially planar surface 23, which tightly mates with upper surface 17 of rib 12 from side surface 15 thereof to side surface 16, and with the lateral surfaces 24, 25 which are likewise substantially planar and which divert mutually downwardly from surface 17 at an angle which is substantially the same as that of the side surfaces 15 and 16 of rib 12, and are pressed respectively laterally thereagainst, from the upper surface 17 of rib 12 to the immediate vicinity of upper surface strip 10 and upper surface strip 11, respectively.

Towards the bottom, lateral surfaces 24 and 25 of channel 22 are respectively connected to a lower surface strip 26 of the support element 19 and to a lower surface strip 27 of element 19, which surfaces 26 and 27 are substantially planar, coplanar and symmetrical to one another with respect to plane 3 to which they are substantially perpendicular. Surfaces 26 and 27 are positioned to face the upper surface strip 10 and upper surface strip 11, respectively, and are substantially parallel with strips 10 and 11 and are spaced therefrom to permit a certain amount of play with respect to the strips.

In a perpendicular direction from plane 3, the lower surfaces of strips 26 and 27 of the support element 19 connect the lateral surface 24 of channel 22 to a lateral surface 28 of support element 19 and lateral surface 25 of channel 22 to a lateral surface 29 of support element 19, which surfaces 28 and 29 are substantially planar, parallel, and symmetrical to one another with respect to the plane 3 and connect lower surface strip 26 and lower surface strip 27 to an upper substantially planar surface 30 at the top of support element 19. Surface 30 is substantially parallel to the lower surface strips 26 and 27 of the support element 19, i.e., substantially horizontal and perpendicular to plane 3. Surfaces 23–30 which have just been described extend in a continuous manner from end surface 20 to end surface 21 of the support element 19, the axis 18 being positioned between the end zone 23 of channel 22 and the lower surface strips 26 and 27 of the support element 19.

Along axis 18, surfaces 28 and 29 of support element 19 carry in an affixed manner, respectively above the upper surface strip 10 and above the upper strip 11, swivels 31 and 32 which have exterior peripheral respective surfaces 33 and 34, from the respectively associated surface 28 and 29 of the support element 19 to a respective end surface 35, 36, which is substantially planar and perpendicular to the axis 18 and coplanar, respectively, with the surface of side 8 of the ski 1 and with the surface of side 9 thereof. It is contemplated that swivels 31, 32 could be mounted through rib 12 without support element 19. In such a case, a single swivel could extend through rib 12 and have a width substantially equal to the distance between end surfaces 35, 36. Further, a bearing sleeve could optionally be positioned within rib 12 for rotatably mounting the single swivel.

Each of the swivels 31 and 32 is carried adjacent to the corresponding respective surface 28, 29 in a manner to assist supporting element 19, by virtue of a respective sleeve 37, 38, which assures rotational guidance around axis 18 of element 19. To this end, each of sleeves 37 and 38 has an interior peripheral surface 39, 40 which is a cylinder of revolution around axis 18 with a diameter approximately identical to that of the exterior peripheral surface 33, 34 of swivel 31, 32 which respectively corresponds to assure, by sliding contact, relative rotational guidance around axis 18. Furthermore, each sleeve 37, 38 has an exterior peripheral surface 41, 42 which is likewise a cylinder of revolution around axis 18 with a radius less than the distance separating axis 18 from the upper surface strips 10 and 11 of ski 1. Surfaces 39 and 41 or sleeve 37 are connected mutually by annular end surfaces, which are planar and perpendicular to axis 18. End surface 43 is in slidable contact against surface 28 of support element 19 and end surface 44 faces oppositely to surface 43.

Likewise, surfaces 40 and 42 of sleeve 38 are mutually connected by two annular end surfaces 45, 46, which are substantially planar and perpendicular to axis 18. End surface 45 is in sliding contact with surface 29 of support element 19 and end surface 46 faces oppositely to end surface 45. The distance separating end surfaces 43 and 44 of sleeve 37 and the distance separating end surfaces 45 and 46 of sleeve 38 are substantially identical, and they are less than the distance which respectively separates surfaces 28 and 29 of the support element 19, and the respective end surfaces 35 and 36 of swivels 31 and 32.

Thus, on each of sleeves 37 and 38 on swivels 31, 32, there are respective zones 47 and 48 of the exterior peripheral surfaces 33, 34 thereof, each zone being respectively positioned in the immediate proximity of the end surface 35 of swivel 31 and in the immediate proximity of the end surface 36 of swivel 32.

Through zones 47 and 48, swivels 31 and 32 provide for the rotatable mounting of a rigid linkage element 49 with respect to sleeves 37 and 38, with respect to support element 19, and with respect to ski 1, without relative displacement of the linkage element 49, sleeves 37 and 38, and support element 19, along axis 18 or radially with respect to axis 18.

To this end, in the example illustrated, the linkage element 49 is in the form of a cap which overlaps the support element 19 and the two sleeves 37 and 38. More precisely, the linkage element 49 comprises two wings 50 and 51 having a generally flat and elongated shape, which are substantially parallel and symmetrical to one another with respect to the longitudinal median plane 3 of the ski, which wings 50 and 51 extend, respectively, along surface 44 of sleeve 37 and surface 46 of sleeve 38, and are connected above the upper surface 30 of support element 19, slightly in front of axis 31, with reference to the positions illustrated in FIGS. 1, 2, 3, 5, 6, through arm 52 which is likewise flat and elongated, and substantially perpendicular to plane 3 with respect to which it is symmetrical. The two wings 50 and 51 rise towards the front, with reference to direction 2, in the positions illustrated in FIGS. 1, 2, 3, 5, 6, in which they form an average angle on the order of about 70 degrees with the upper surface strips 10 and 11 of ski 1. In the position illustrated in FIG. 4, they form however, an average angle on the order of about 60 degrees with the upper surface strips 10 and 11 after rotation of the linkage element 49 around axis 18, with respect to support element 19 and ski 1, in direction 53 going from rear to front, with reference to direction 2, above axis 18.

Wings 50 and 51, have respective facing surfaces 54 and 55 which are substantially planar, parallel, and symmetrical to one another with respect to plane 3, and surfaces 54 and 55 are spaced mutually by a distance which coincides substantially with the distance separating the respective surfaces 44 and 46 of sleeves 37 and 38 when the sleeves rest through their surfaces 43 and 45 respectively against surface 28 and against surface 29 of support element 19, such that a sliding contact is established between the surface 54 and the surface 44, on the one hand, and between the surface 55 and the surface 46, on the other hand. In a perpendicular direction with respect to plane 3, wings 50 and 51 are defined by spaced surfaces 56 and 57 which are likewise substantially planar, parallel, and symmetrical to one another with respect to the plane 3. Surfaces 56 and 57 are spaced by a distance corresponding to the spacing between and surfaces 35 and 36 of swivels 31 and 32. Further, surfaces 56 and 57 are respectively substantially coplanar with the surface of side 8 of the ski 1 and with the side surface 9 thereof. In each of wings 50 and 51 there is provided along axis 18 a respective bore 58 and 59 which opens to the two previously cited surfaces of the wings, which bore 58, 59 is defined by a respective surface 60, 61 which is a cylinder of revolution around axis 18 with a diameter which is approximately identical to that of the exterior peripheral of surface 33, 34 of the respectively associated swivel 31, 32 to assure the swivel-mounting of linkage element 49.

Wings 50 and 51 furthermore have respective sides 62 and 63 defined by generators substantially perpendicular to longitudinal median plane 3 of the ski 1. With reference to the positions illustrated in FIGS. 1, 2, 3, 5, 6, these sides 62 and 63 present, at the rear of the plane 64 perpendicular to the direction 2 and including axis 18, lower respective surfaces 65 and 66 which are substantially planar, coplanar and positioned at a level below that of axis 18 such that the surfaces 65 and 66 rest flat on the upper surface strips 10 and 11 of ski 1, respectively, in the positions illustrated in FIGS. 1, 2, 3, 5, 6, to define by such a support a stable angular position of the linkage element 49 with respect to the support element 19 and to the ski 1, corresponding to a limit of rotation of linkage element 49 with respect to support element 19 and to ski 1 and in a direction 67 opposite to direction 53. Towards the front, the surfaces 65 and 66 are connected, by respective surfaces such as 68 of a envelope cylinder of revolution around axis 18, having respective front surfaces such as 69 of sides 62 and 63, which surfaces are substantially planar, coplanar, and ascending towards the front in all of the positions illustrated in FIGS. 1–6. Likewise, towards the rear, the surfaces 65 and 66 are connected to respective rear surfaces 70 and 71 of sides 62 and 63 which surfaces are likewise substantially planar, coplanar, and rise towards the front in all of the positions illustrated in FIGS. 1–6.

Figure 2:
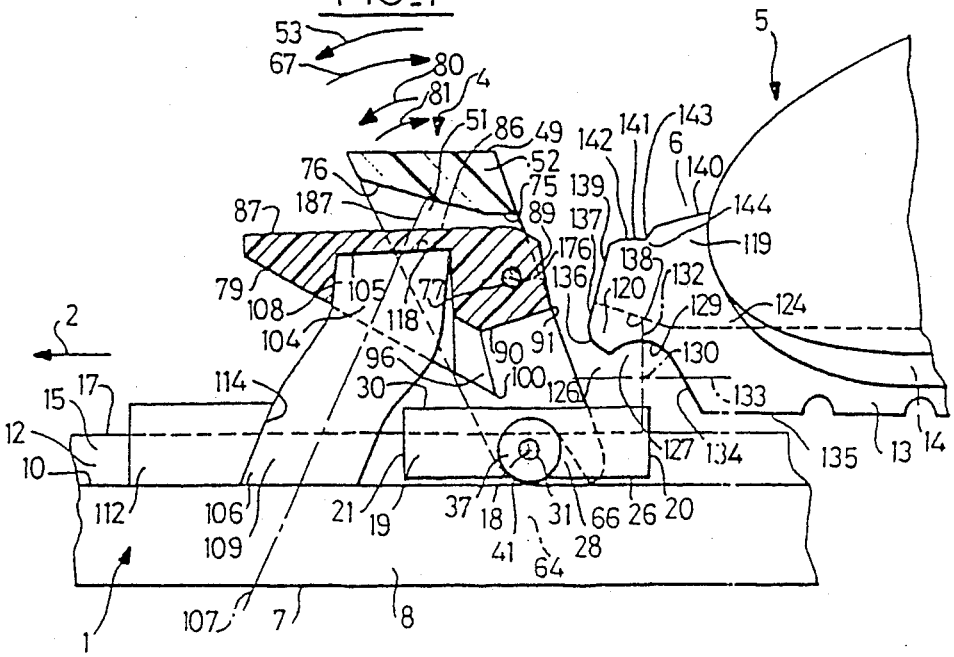
FIG. 2 illustrates, in a view analogous to that of FIG. 1, the binding in the course of the insertion or removal of the boot, while the linkage element occupies the stable angular position and the latching element occupies the release position.
Figure 3:
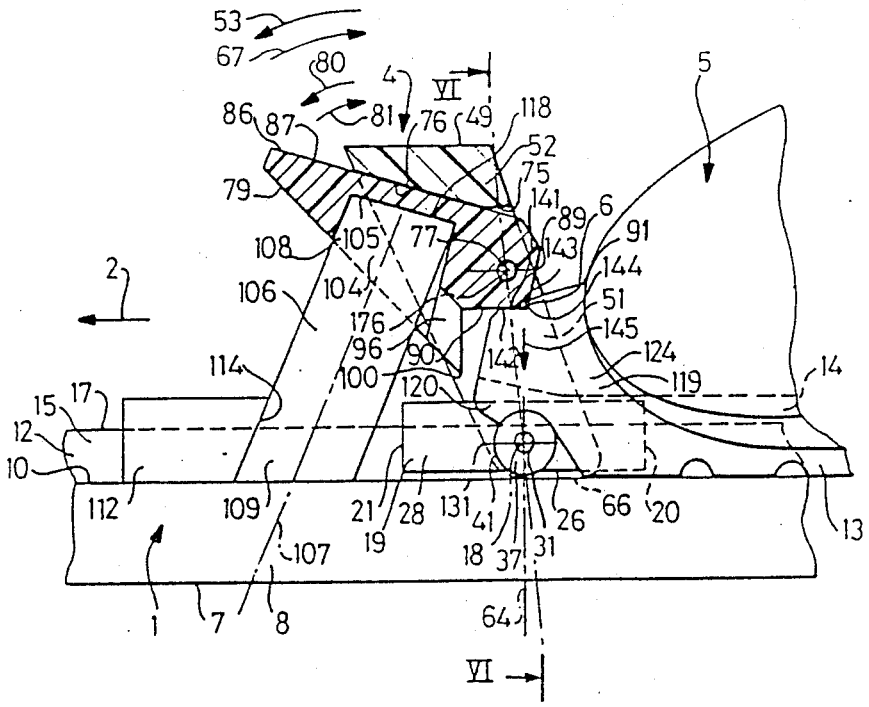
FIG. 3 illustrates, in a view analogous to that of FIGS. 1 and 2, the binding in the case where the boot has been inserted, while the linkage element occupies the stable angular position, the latching element occupies its retention position of a front zone of the boot, and the boot rests flat on the ski.
Figure 4:
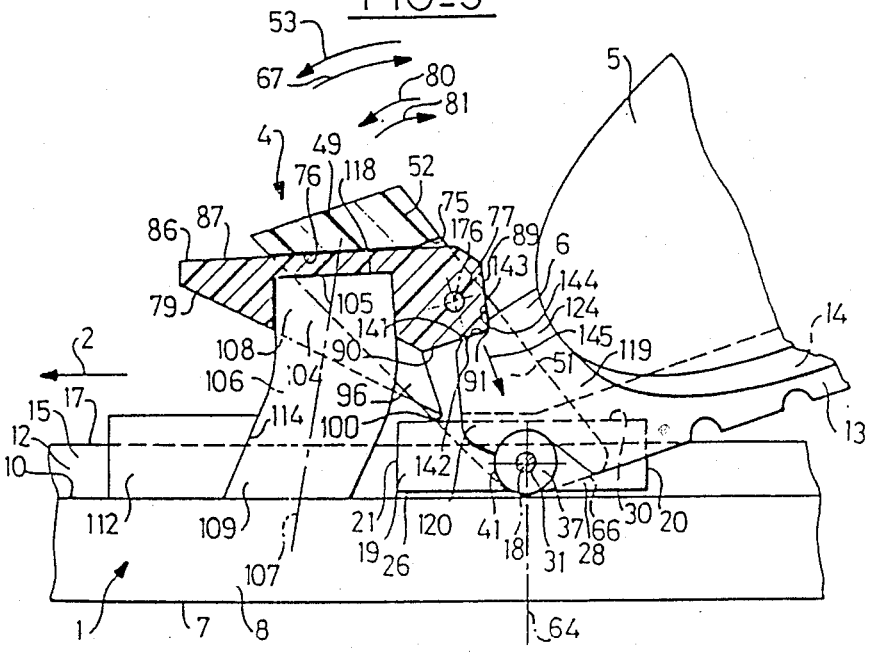
FIG. 4 illustrates, in a view analogous to that of FIGS. 1, 2, and 3, the binding during extensional movement of the foot, the linkage element occupying a position which is angularly offset with respect to the stable angular position while the latching element occupies its retention position of the front zone of the boot.
Figure 5:
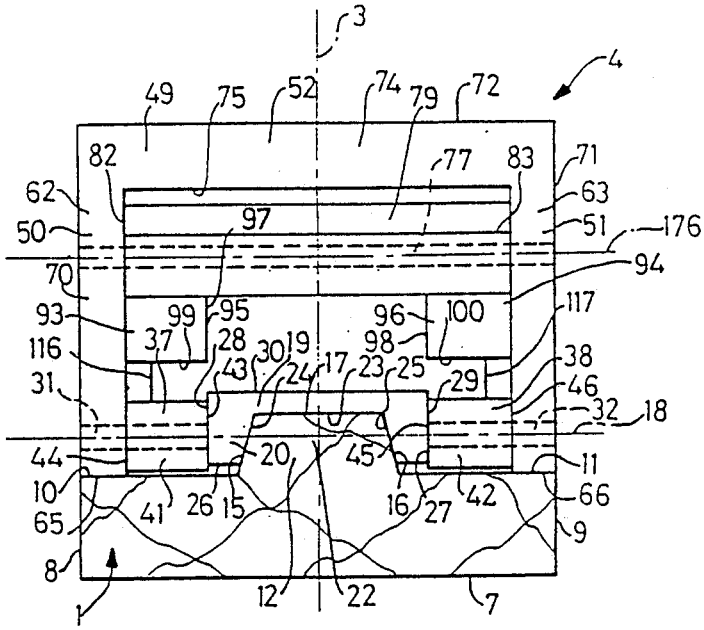
FIG. 5 illustrates, in a view in transverse cross-section along a plane perpendicular to the longitudinal median plane of the ski and whose outline is identified as V—V of FIG. 1.

Towards the top, wings 50 and 51 and arm 52 are defined by a substantially planar surface 72, substantially perpendicular to the longitudinal median plane 3 of the ski and positioned substantially horizontally in the positions illustrated in FIGS. 1, 2, 3, 5, 6, and inclined towards the front in the position illustrated in FIG. 4. Respectively towards the front and the rear, arm 52 is defined, beneath surface 72, respectively, by substantially planar surfaces 73 and 74, which extend in a substantially coplanar fashion, respectively, with the front surfaces such as 69 of wings 50 and 51 and the rear surfaces 62 and 63 of the latter, between the surfaces 54 and 55.

Towards the bottom, arm 52 is defined in the immediate vicinity of surface 74 by a substantially planar surface 75, substantially parallel to surface 72 facing downwardly, i.e., towards the support element 19. From the immediate proximity of surfaces 73 to surface 75, arm 52 is furthermore defined on the bottom by a substantially planar surface 76 which is likewise substantially perpendicular to the longitudinal median plane 3 of the ski. Surface 76 rises towards the front in the positions illustrated in FIGS. 1, 2, 3, 5, 6, and slightly descends towards the front in the position illustrated in FIG. 4. The surfaces 75 and 76 thus extend from surface 54 of wing 50 to surface 55 of wing 51.

Between axis 18 and surface 75 of arm 52, wings 50 and 51 are connected mutually, in an affixed manner, by a rigid rectilinear swivel 77 having an exterior peripheral surface 78, which is a cylinder of revolution around an axis 176, substantially parallel to axis 18 and positioned in front of plane 64 in the position illustrated in FIGS. 1, 2, 3, 5, 6, as well as in the position illustrated in FIG. 4, and more precisely between the axis 18 and the surface 75 of the arm 52 of the linkage element 49, closer to the surface 75 than to axis 18

By this swivel 77, linkage element 49 carries a rigid latching element 79, rotatably mounted around axis 176, without the possibility of any other relative displacement. Latching element 79 is adapted to occupy, with respect to the linkage element 49, a retention position, illustrated in FIGS. 1, 3, 4, 5, 6, in which it affixes the front end zone 6 of boot 5 with linkage element 49 with respect to rotation around axis 18, with respect to support element 19, and with respect to ski 1, and a release position, illustrated in FIG. 2 in which the latching element 79 allows for removal of the boot by removal of the front end zone 6 of boot 5, or insertion of the boot. The passage from the retention position to the release position occurs by rotation of latching element 79 around axis 176, with respect to the linkage element 49, in a direction 80 from the rear to the front above axis 176, while the passage from the release position to the retention position occurs by rotation of the latching element 79 in the opposite direction 81 around axis 176 with respect to linkage element 49.

For reasons of clarity with respect to the description, latching element 79 will be described essentially in its retention position of the front end zone 6 of boot 5 with respect to linkage element 49 occupying, with respect to support element 19 and ski 1, its angular support position of surfaces 65 and 66, and its wings 50 and 51 on the upper surface strips 10 and 11 of ski 1, which corresponds to the support or the boot flat on the ski. This combination of positions is illustrated in FIGS. 1 and 3. However, with reference in the first instance to FIGS. 5 and 6, it will be noted that the latching element 79 is defined, in the direction transverse to the longitudinal median plane 3 of ski 1, by two planar surfaces 82 and 83 which are substantially parallel and symmetrical to one another with respect to plane 3. Surfaces 82, 83 are spaced by a distance corresponding substantially to the distance separating surfaces 54 and 55 of wings 50 and 51 such that, through surfaces 82 and 83, latching element 79 is in sliding respective contact with surface 54 of wing 50 of linkage element 49 and with surface 55 of wing 51 of linkage element 49, while latching element 79 is bored between surfaces 82, 83 by bore 84 having an interior peripheral surface 85 which is a cylinder of revolution around axis 176 with a diameter corresponding substantially to that of the peripheral surface 78 of swivel 77 to ensure the above-mentioned swivel-mounting of the latching element 79 on linkage element 49, without the possibility of relative displacement other than relative rotation around axis 176.

With reference more particularly to FIGS. 1 and 3, it is seen that the latching element 79 is essentially defined on top by an upper planar surface 86 which is substantially perpendicular to the longitudinal, median plane 3 of the ski 1 (FIGS. 5 and 6) and is supported flat against surface 76 of arm 52 of the linkage element 49 in the positions illustrated in FIGS. 1 and 3 while, in the position illustrated in FIG. 2, the surfaces 86 and 76 define between them a wedge-shaped space 187 which converges towards the rear. In the positions illustrated in FIGS. 1 and 3, the upper surface 86 of the latching element 79 has a zone 87 which projects towards the front with respect to surface 73 of arm 52 of linkage element 49 and thus faces forwardly with reference to direction 80, to define by this zone 87 a voluntary application surface, to the latching element 79, for example, by means of a ski pole, of a pressure in the direction 80 to voluntarily cause the passage of the latching element 79, from the retention position to the release position, as will appear below. It will be noted that in the position illustrated in FIG. 4, the surface 86 is approximately horizontal and converges slightly forwardly with respect to the upper surface strips 10 and 11 of ski 1.

Towards the rear, with reference to the direction 2, and still with reference to FIGS. 1 and 3, surface 86 extends substantially to plane 64, i.e., to the rear of axis 176, and is connected to a facet 88 which is likewise substantially planar and perpendicular to the longitudinal median plane 3 of ski 1, which facet 88 extends downwardly with respect to surfaces 86, by forming with it a angle on the order of 15 degrees. Facet 88 thus connects surface 86 towards the rear to a surface 89 which is likewise substantially planar and perpendicular to the longitudinal median plane 3 of the ski, with surface 89 forming a dihedral angle of approximately 90 degrees with respect to surface 86. Surface 89 thus faces towards the rear and is situated to the rear of axis 176, with reference to direction 2, in the position illustrated in FIGS. 1 and 3, and connects surface 88 towards the bottom by a rectilinear edge 91 which is substantially perpendicular to the longitudinal median plane 3 of the ski, to a surface 90 which is likewise substantially planar and perpendicular to the longitudinal median plane 3 of ski 1 and which faces downwardly towards the ski. In the position illustrated in FIGS. 1 and 3, edge 91 is positioned in the vicinity and at the rear of a geometrical plane passing through axes 18 and 176, between the respective levels of these two axes, and the surface 90, situated between axis 176 and upper surface 17 of the rib 12 is approximately parallel to the upper surface strips 10 and 11 of the ski 1, i.e., approximately horizontal. Surfaces 89, 90 generally define a convex projection for reception in a generally concave seat of the front portion of the ski boot, which is described below. It is also contemplated that, instead of edge 91 being rectilinear, it could be rounded, so that surfaces 89, 90 would define a generally continuous convex surface.

Defined towards the rear by edge 91, surface 90 is likewise defined towards the front by a rectilinear or rounded edge 92 which is substantially perpendicular to the longitudinal median plane 3 of the ski 1. In the immediate vicinity of surfaces 82 and 83, surface 90 is connected by this edge 92 to respective substantially planar surfaces 93 and 94 of projections 95 and 96 which are positioned to project beneath surface 90, symmetrically to one another with respect to the longitudinal median plane 3 of the ski 1. The two surfaces 93 and 94 are substantially coplanar, and face towards the rear with reference to the direction 2 and extend substantially vertically, in front of axis 176, with reference to the position illustrated in FIGS. 1 and 3. In the position illustrated in FIG. 2, the two surfaces 93 and 94 descend towards the rear. As will appear more clearly below, the two projections 95 and 96 serve for removal of the boot.

Defined respectively by the surface 82 and the surface 83 in a direction transverse to the longitudinal median plane 3 of the ski, these two projections 95, 96 are defined on their interiors by respective surfaces 97 and 98 which are substantially planar, parallel, and symmetrical to one another with respect to the plane 3 to which they are substantially parallel. Planar surfaces 97 and 98 are positioned substantially coplanar, respectively, with surface 28 of support element 19 and with surface 29 thereof, such that projections 95 and 96 do not constitute an obstacle to pivoting of the linkage element 49 and latching element 79 in direction 80 around axis 18 during extensional movements of the foot in the normal limits of use of the binding, which can lead to a sliding of surface 95 against surface 28 and of surface 96 against surface 29.

Surfaces 93 and 94 extend, transversely to plane 3, respectively from surface 82 to surface 97 and from surface 83 to surface 98. Towards the bottom, these two surfaces 93 and 94 extend to respective rectilinear edges 99 and 100, substantially perpendicularly to plane 3, and are positioned as the extension of one another, which edges 99 and 100 constitute the respective connections of surfaces 93 and 94 with respective coplanar extensions, symmetrical to one another with respect to plane 3, of a substantially planar surface 101 substantially perpendicular to the longitudinal median plane 3 of ski 1 and facing downwardly towards the front, by forming an angle of approximately 45 degrees with respect to the upper surface strips 10 and 11 of ski 1 in the position illustrated in FIGS. 1 and 3. This surface 101 extends towards the front to a facet 102, which is likewise substantially planar and perpendicular to the longitudinal median plane 3 of ski 1, which facet 102 faces towards the front, at approximately 90 degrees with respect to surface 86 to Which it connects to surface 101.

Between surfaces 97 and 98 of projections 95 and 96, surface 90 is connected by edge 92 to a substantially planar surface 103 which is approximately parallel to the surface 101 and of the same orientation, which surface 103 connects towards the front an encasement space 104 provided in the form of a recessed opening in the mass of the latching element 79, within surface 101 thereof, substantially symmetrically with respect to the longitudinal median plane 3 of the ski, between the surfaces 82 and 83 on the one hand, between the edge 92 and the facet 102 on the other hand, i.e., in front of axis 176 with reference to the position illustrated in FIGS. 1 and 3 and to the positions illustrated in the FIGS. 2 and 4.

The recessed space 104, descending towards the front in the position illustrated in FIGS. 1 and 3 and approximately vertical in the positions illustrated in FIGS. 2 and 4, presents in particular a substantially planar bottom surface 105, substantially parallel to the surface 86 of the latching element 79 but facing opposite to surface 86. In other words, the bottom surface 105, situated in front of axis 176, faces forwardly with reference to direction 81 in the position illustrated in FIGS. 1 and 3 and to the positions illustrated in 2 and 4. With reference to the positions illustrated in FIGS. 1, 3, 4, surface 195 is likewise placed directly opposite the zone of contact of surface 86 of latching element 79 with surface 76 of arm 52 of linkage element 49, which faces forwardly, as with surface 76 with reference to direction 67.

The recessed opening 104 receives, in the interior of the latching element 79, and in support against the end surface 105, an elastically compressible element 106 formed, for example, in the form of a block of expanded elastomeric material presenting, with reference to its state illustrated in FIGS. 1 and 3, a shape which is elongated along an average rectilinear direction 107, situated along the longitudinal median plane 3 of ski 1, which direction 107 descends towards the front. An upper end 108 of the elastically compressible element 106 is positioned within opening 104 and is supported against end surface 105 thereof, and a lower end 109 of the elastically compressible element 106 is supported at the bottom and towards the front on ski 1 in front of the support element 19 and in front of axis 18. To this end, the lower end 109 of the elastically compressible element 106 presents, in transverse cross section with respect to direction 2, as illustrated in the cut-away view in FIG. 1, a shape which is closely complementary to that of rib 12, received in the channel 110 of the lower end 109, and upper surface strips 10 and 11 of the ski 1, immediately adjacent to the rib 12, to offer a maximum support surface of the lower end 109 of the elastically compressible element 110 on the ski 1.

Towards the front, the elastically compressible element 106, in its state illustrated in FIGS. 1 and 3, is defined by a planar surface 111, substantially perpendicular to the longitudinal median plane 3 of the ski 1 and substantially parallel to direction 107, which surface 111 is inclined with respect to the upper surface 17 of rib 12 and with respect to the upper surface strips 10 and 11 of ski 1 engages, in the immediate vicinity of the lower end 109 of the elastically compressible element 106, under a support shoe 112 applied in an affixed manner on ski 1, in front of the axis 18, independently of the support element 19 in the example illustrated.

Support shoe 112 may also be made of one piece with support element 19. The support shoe 112 presents on the bottom a shape adapted to mate as well as possible with rib 12 of ski 1 as well as with the upper surface strips 10 and 11 thereof. Particularly, it presents a longitudinal channel 113 receiving rib 12. Towards the rear, it is defined by a substantially planar surface 114 which is substantially perpendicular to the longitudinal median plane 3 of ski 1 and inclined with respect to the upper surface strips 10 and 11 thereof as well as with respect to the upper surface 17 cf rib 12 in the same manner as surface 111 of the elastically compressible element 106, such that the lower and 109 thereof is compressed at the bottom, as well as towards the front and on top, between surface 114, on the one hand to surface 17 of rib 12 and the upper surface strips 10 and 11 of the ski 1, on the other hand. Towards the rear, the elastically compressible element 106, such as is illustrated in FIGS. 1 and 3, is defined by a surface 115 which is substantially planar and parallel to the surface 111 while, in the transverse direction with respect to the plane 3, it is defined by two surfaces 116 and 117, which are likewise substantially planar, and parallel and symmetrical to one another with respect to plane 3 and spaced by a distance intermediate between the distance separating the sides 8 and 9 of the ski 1 and the distance between surfaces 28 and 29 of the support element 19. Towards the top, the elastically compressible element 106 is defined by a substantially planar surface 118 supported, flat, against the end surface 105 of recessed space 104.

In the position illustrated in FIGS. 1 and 3, the elastically compressible element 106 is not compressed, particularly along direction 107 or, in a preferred manner, it is slightly pre-stressed in compression along direction 107 between, on the one hand, the assembly formed by the ski 1 and the support shoe 112, and on the other hand, the latching element 79 supported through its surface 86 against surface 76 of arm 52 of the linkage element 49, itself occupying its preferred angular position of support through surfaces 65 and 66 of wings 50 and 51 against the upper surface strips 10 and 11 of ski 1. This position of the binding assembly 4 represents a stable state towards which the elastically compressible element 106 tends to return the binding in the case where (1) the latching element 79 pivots in direction 80 with respect to linkage element 49, and (2) the linkage element 49 pivots in direction 53 with respect to support element 19 and ski 1, and jointly with latching element 79 (movements illustrated, respectively, in FIGS. 2 and 4).

The elastically compressible element 106 could be replaced by at least one other element which is likewise elastically compressible along direction 107, and which is firmly connected to latching element 79 on the one hand, and to support means which are fixed with respect to ski 1 such as support shoe 112 or fixed with the ski 1 itself, on the other hand to elastically bias the latching element 79 and the linkage element 49 in the manner described with respect to the elastically compressible element 106. For example, elastically compressible element 106 could be replaced by at least one elastically telescopic shaft along direction 107, journalled on the one hand on the latching element 79 and on the other hand on the ski 1, around respective axes substantially parallel to axes 18 and 176.

To cooperate with the binding described heretofore, the front end 6 of boot 5 has a shape which is most clearly shown in FIG. 2 but, for reasons of clarity of description, will be described with reference to its position illustrated in FIGS. 3 and 6.

It becomes clear from the figures that the zone of the front end 6 of boot 5 is, in this embodiment, defined by a rigid front projection 119 of sole 13. However, other embodiments can be selected where necessary without going beyond the scope of the present invention, including modifications of the binding 4 within the ability of one of ordinary skill in the art.

It is also clear from FIGS. 3 and 6 that projection 119, essentially situated above support element 19 and engaged within linkage element 49, below surface 90 and edge 91 of latching element 79, is subdivided towards the front and bottom into two flaps 120 and 121 which are substantially symmetrical to one another with respect to longitudinal median plane 3 of ski 1 and intercalated, respectively, between surface 28 of support element 19 and surface 54 of wing 50 of linkage element 49 and surface 29 of support element 19 and surface 55 of the wing 51 of linkage element 49 to nest and rest in a centripetal manner. With reference to axis 18, flaps 120 and 121 respectively rest on sleeve 37 and sleeve 38, rotatably around axis 18, with respect to the support element 19 and ski 1, during insertion of the boot and removal of the boot, with respect to the assembly formed by linkage element 49 and latching element 79.

More specifically, the two flaps 120 and 121 present towards one another, i.e., likewise towards the longitudinal median plane 3 ski 1, respective surfaces 122 and 123 which are substantially planar, parallel, and symmetrical to one another with respect to plane 3 and spaced by a distance corresponding substantially to the spacing of surfaces 28 and 29 of support element 19, in a manner so as to establish a sliding contact of surfaces 122 and 123 with surfaces 28 and 29, respectively. Surfaces 122 and 123 can preferably constitute extensions of the side surfaces of groove 14 of sole 13.

In a substantially perpendicular direction from longitudinal median plane 3 of ski 1, flaps 120 and 121 are defined, as is the end projection 119, by lateral surfaces 124 and 125, respectively, which are substantially planar, parallel, and symmetrical to one another with respect to plane 3 and spaced by a distance corresponding substantially to the spacing of surfaces 54 and 55 of wings 50 and 51 of linkage element 49 so as to establish a sliding contact between surface 124 and surface 54, on the one hand, and between surface 125 and surface 55, on the other hand.

Towards the bottom and front, surfaces 124 and 125 are connected, respectively, to surfaces 122 and 123 by side surfaces such as 126 of flap 120, e.g., defined by rectilinear generators substantially perpendicular to longitudinal median plane 3 of ski 1 and hollowed out with a respective opening 127 and 128, which is likewise defined by generators substantially perpendicular to longitudinal median plane 3 of ski 1, and open towards the bottom and opening, respectively, into surfaces 122 and 124 and into surfaces 123 and 125.

Figure 6:
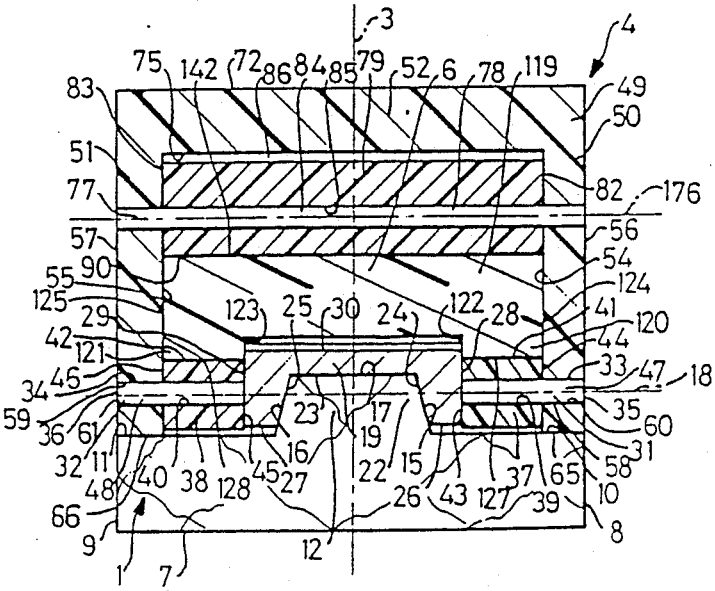
FIG. 6 illustrates, in a view in transverse cross-section along a plane perpendicular to the longitudinal median plane of the ski and whose outline is identified as VI—VI of FIG. 3.

As will become more clear, particularly from FIG. 2, with reference to side surface 126 of flap 120 and opening 127 thereof, to which the opening 128 of flap 121 is identical in every respect, each of openings 127 and 128 is defined towards the top by a surface such as 129 which faces downwardly, approximately mating with the shape of a quarter of a cylinder of revolution around an axis 130, which is substantially parallel to axis 18 in the position illustrated in FIGS. 3 and 6. Each of openings 127 and 128 has a diameter substantially adaptable to that of surfaces 41 and 42 of sleeves 37 and 38 such that, when the boot occupies its position illustrated in FIG. 3, the surfaces such as 129 mate respectively with surface 41 of sleeve 37 and surface 42 of sleeve 38 over the entirety of a quarter of these surfaces situated above a plane 131, substantially parallel to the upper surface strips 10 and 11 of ski 1 and passing through axes 18 and 130, which are substantially coincident in the position illustrated in FIG. 3.

Each of the surfaces such as 129 is symmetrically distributed on either side of a plane 132 which includes axis 130 and is substantially coincident with plane 64 in the position illustrated in FIG. 3. Each of the surfaces such as 129 extends downwardly, to the rear of axis 130, to beneath plane 133, substantially coincident with the plane 131 in the position illustrated in FIG. 3, by a surface such as 134 which is substantially planar and perpendicular to longitudinal median plane 3 of ski 1, and descends towards the rear at an angle of approximately 45 degrees with respect to plane 133, and connects towards the bottom to a lower surface such as 135 of sole 13, adapted to rest on the upper surface strip such as 10 of ski 1 in the position illustrated in FIG. 3. In front of axis 130, each surface such as 129 is connected above plane 133 to a respective substantially planar surface such as 136, substantially perpendicular to longitudinal median plane 3 of ski 1 and rises towards the front in the position illustrated in FIG. 3. Towards the front, the surface such as 136 is connected to a respective front surface such as 137 of flaps 120 and 121, which surface 137 is convex in the example illustrated, but could likewise assume any other shape adapted so as not to interfere with the pivoting movements of boot 5 around axis 18 with respect to ski 1, which will be described below.

Likewise, between surfaces 122 and 123 above upper surface 30 of the support element 19, with reference to the position illustrated in FIG. 3, projection 119 is defined by a surface 138 which is substantially planar and perpendicular to longitudinal median plane 3 of ski 1 and rises towards the front with an orientation adapted so as not to interfere with movement of the boot as just mentioned. The surface 138 preferably constitutes the extension of an end surface of groove 14 of sole 13 of boot 5 with end projection 119.

The front surfaces such as 137 of flaps 120 and 121, towards the top, and the surface 138, towards the front, are connected to a front surface 139 of projection 119, which surface 139 is, for example, substantially planar and perpendicular to longitudinal median plane 3 of ski 1 and rises towards the rear, with an inclination of approximately a few degrees with respect to the vertical, in the position illustrated in FIG. 3. Front surface 139 extends substantially perpendicular to longitudinal median plane 3 of the ski, from side surface 124 of projection 119 to side surface 125 thereof.

Towards the top, surface 139 as well as side surfaces 124 and 125 of projection 119 are connected to an upper surface 140 thereof, which upper surface 140 presents, in the example illustrated, a generally planar shape, substantially perpendicular to longitudinal median plane 3 of ski 1 and rises towards the rear with an inclination of approximately a few degrees with respect to the horizontal, in the position illustrated in FIG. 3. Upper surface 140 is cut-away with a rectilinear groove 141 which extends substantially perpendicular to longitudinal median of plane 3 of ski 1, from side surface 124 of projection 119 to side surface 125 thereof. Seen in cross-section along longitudinal median plane 3 of ski 1 or by any plane parallel to plane 3, groove 141 presents a V-shaped cross-section defined by two surfaces which are substantially planar and perpendicular to longitudinal median plane 3 of ski 1, namely a front surface 142 and a rear surface 143 which are connected by a rectilinear edge 144, which is likewise substantially perpendicular to longitudinal median plane 3 of ski 1. Surfaces 142, 143 generally define a concave seat for reception of the generally convex projection of surfaces 89, 90. It is also contemplated that, instead of edge 144 being rectilinear, it could be rounded, so that the surfaces 142, 143 define a generally continuous concave surface.

With respect to planes 132 and 133, surfaces 142 and 143 and edge 144 occupy positions identical to those that are occupied, with respect to planes 64 and 131, respectively, the zone of surface 90 which is adjacent edge 91, the zone of surface 89 which is adjacent edge 91 and edge 91 itself when latching element 79 and linkage element 49 occupy their positions illustrated in FIGS. 1 and 3. Further, in the position illustrated in FIG. 3, the respective zones of surfaces 89 and 90 adjacent edge 91 mate, respectively, with surface 143 and surface 142, edge 91 coinciding with edge 144 and, particularly, surface 90 is supported on surface 142 to place and retain projection 119 of front end 6 of boot 5 through surfaces such as 129 of openings 127 and 128 of flaps 120 and 121, which are radially supported, with reference to axis 18, on respective surfaces 41 and 42 of sleeves 37 and 38, in a direction schematically illustrated by arrow 145 from the zone of surface 90, which is directly adjacent to edge 91, towards the axis 18, radially with respect thereto, and at the rear of axis 176. As shown in FIG. 3, while being biased by element 106, latching element 79 is supported through surface 86 against surface 76 of linkage element 49 which is itself maintained thus in support by surfaces 65 and 66 of wings 50 and 51 against the upper surface strips 10 and 11 of ski 1.

Figure 11:
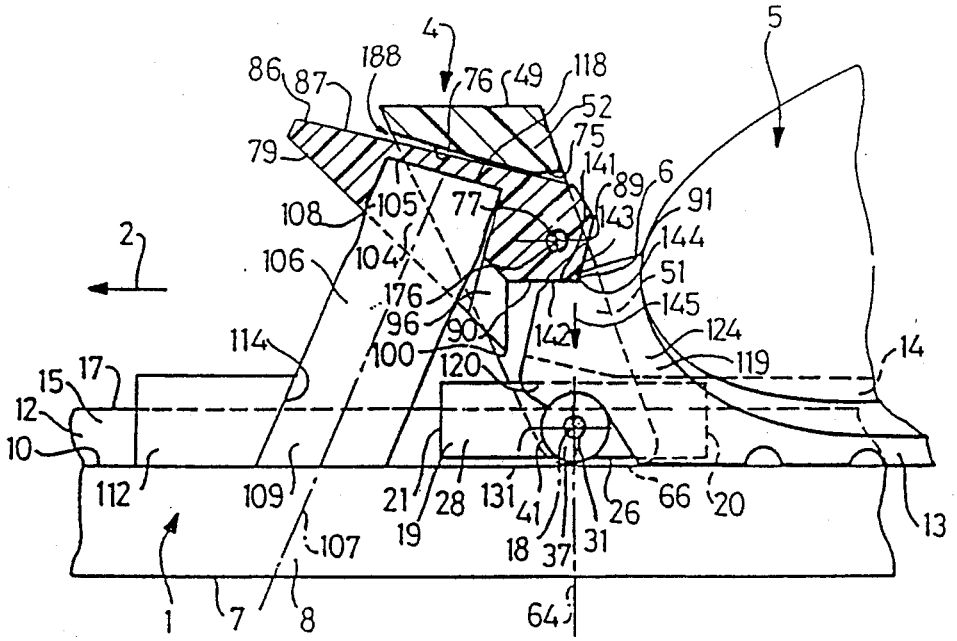
FIG. 11 illustrates, in a view analogous to that of FIG. 3, an alternative embodiment of the binding in its retention position.

In an alternative embodiment, as shown in FIG. 11, while presenting a relative arrangement which is identical to that of the zones of surfaces 89 and 90 immediately adjacent to edge 91, surfaces 143 and 142 of groove 141 could be spaced farther from axis 130 than the zones of surfaces 89 and 90, which are immediately adjacent to edge 91, which are not spaced farther from axis 18 in the position illustrated in FIG. 1, such that, when the latching element 79 engages, through its surfaces 89 and 90, surfaces 143 and 142 of projection 19, its surface 86 is slightly spaced from surface 76 of transverse member 52 of linkage element 49, causing a compression of the elastically compressible element 106 along the direction 107, in comparison with the state illustrated in FIG. 1. There will exist also between surfaces 86 and 76, in the position illustrated in FIG. 11, a wedge-shaped space 188 similar to that which is illustrated at 187 in FIG. 2 but of smaller size.

According to a further alternative embodiment, upper surface 140 of projection 119 can be formed without groove 141, such that the latching element 79 rests only through its edge 91 on upper surface 140 in a retention position of the boot, corresponding to the position illustrated in FIG. 3. The construction of these embodiments, with respect to the embodiment described above, is within the normal ability of one of ordinary skill in the art.

The operation and use of the binding 4 is as follows. It can be easily seen that by means of the arrangements which have just been described, as soon as projection 119 of boot 5 is supported by openings 127 and 128 of flaps 120 and 121 on sleeves 37 and 38 and retained in this position by support of latching element 79 in direction 145, shown in FIG. 3, the front end 6 of boot 5, the linkage element 49, and the latching element 79 act as a unitary element with respect to rotation around axis 18 with respect to support element 19 and with respect to ski 1. Thus, starting from the position illustrated in FIG. 3, in which the boot is flat, through its surfaces such as 135 of sole 13, on the upper surface strips 10 and 11 of ski 1, by an extensional movement of the foot, which translates into a rotation of the assembly of the front end 6 of boot 5, linkage element 49, and latching element 79, the skier can bring the binding 4 to the position illustrated in FIG. 4 causing a greater compression of the elastically compressible element 106 along direction 107, between end surface 105 of the recessed opening 104 and the support assembly constituted by the zones of ski 1 adjacent to the support shoe 112 and the support shoe 112 itself. In a manner which can be easily understood by one of ordinary skill in the art, elastically compressible element 106 maintains latching element 79 and linkage element 49 in their relative positions and maintains, consequently, the support of element 79 in direction 145 on projection 119, to retain it supported through openings 127 and 128 on sleeves 37 and 38, with substantially coincident axes 130 and 18. This effect is preserved during the return of the boot and the binding from the position illustrated in FIG. 4 to the position illustrated in FIG. 3.

To remove the boot from the position in which the boot 5 and binding 4 occupy the position illustrated in FIG. 3, the skier applies pressure to zone 87 of latching element 79 in the direction 80 such that, taking into account the arrangement which has been described, latching element 79 pivots in direction 80 around axis 176 with respect to linkage element 49 which itself is maintained in its support position in which surfaces 65 and 66 of wings 50 and 51 are maintained against upper surface strips 10 and 11 of ski 1, as is seen in FIG. 2. This movement is accompanied by an increase in compression of the elastically compressible element 106 along direction 107. In the course of this movement, the projections 95 and 96 of latching element 79, through their edges 99 and 100, come into contact with front surface 139 of projection 119 to apply thereto a pressure towards the rear, while the zones of surfaces 89 and 90, immediately adjacent to the edge 91, are uncovered in the direction opposite to direction 145 from surfaces 143 and 142 of groove 141, which makes it possible to remove the projection 119 with respect to the binding 4 to separate boot 5 from ski 1.

As soon as the pressure exerted on zone 87 of surface 86 of latching element 79 ceases, it regains its position illustrated in FIG. 1 under the effect of elastically compressible element 106, by pivoting in direction 81 around axis 176 with respect to linkage element 49. To insert boot 5 in binding 4 it is again necessary to apply to zone 87 of surface 86 a voluntary pressure in direction 80 to bring latching element 79 to the position illustrated in FIG. 2, with respect to linkage element 49. The skier can then engage projection 119 between the latching element 79 and support element 19 until openings 127 and 128 of flaps 120 and 121 nest on sleeves 37 and 38, with axis 130 and 18 substantially coinciding. This movement accompanies a progressive release of latching element 79 which, moved in direction 81 by elastically compressible element 106, retracts projections 94 and 95 towards the front to free the passage for front surface 139 and projection 119 and returns into support through zones of surfaces 89 and 90 adjacent to edge 91, respectively, against surfaces 143 and 142 of groove 141, as was described with reference to FIG. 3.

In the case of the embodiment which has just been described with reference to FIGS. 1–6, the front end 6 of boot 5 and linkage elements 49 are journalled on support element 19 and on ski 1 around a single axis 18, in a mutually independent manner.

Figure 7:
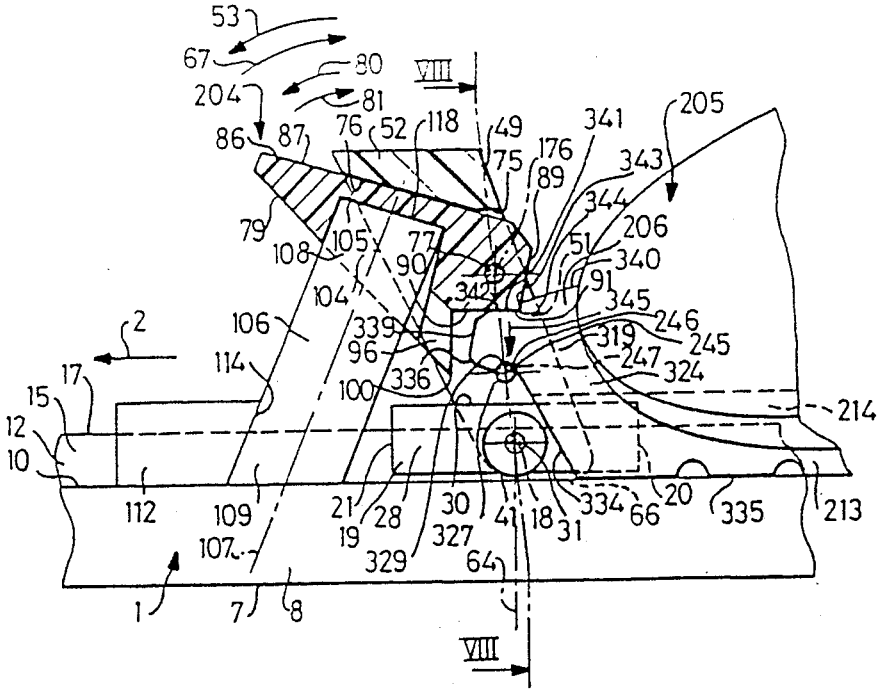
FIG. 7 illustrates, in a view analogous to that of FIG. 3, another embodiment of the binding according to the invention, in the state where the boot is inserted.
Figure 8:
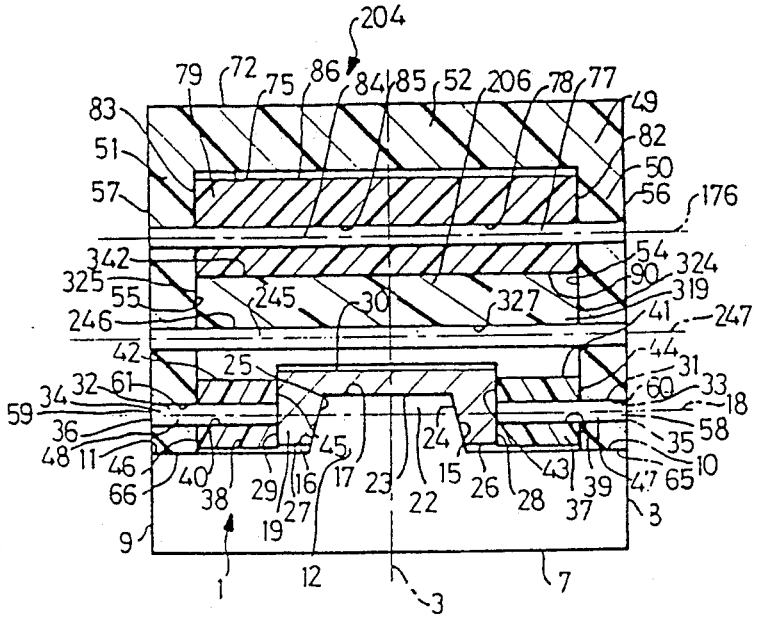
FIG. 8 illustrates a view of the binding of FIG. 7 in cross-section through planes perpendicular to the longitudinal median plane of the the ski and whose outline is identified as VIII—VIII in FIG. 7.

In the embodiment illustrated in FIGS. 7 and 8, on the other hand, the journal of the boot on the ski occurs by means of the linkage element.

However, with a small difference which will now be explained, binding 204 is virtually identical to binding 4 which has just been described. As is seen in FIGS. 7 and 8, substantially the same reference numerals are utilized as in FIGS. 3 and 6, respectively.

The difference between binding 204 and binding 4 described previously resides in the mounting of a swivel 245 at a level between the respective levels of axes 18 and 176, for example midway between these two levels, affixed to wings 50 and 51 of linkage element 49. The swivel 245 presents a peripheral surface 246 which is a cylinder of revolution around an axis 247 substantially parallel to axes 18 and 176. Axis 147 is, in the example illustrated, positioned between the respective heights of axes 18 and 176, while being slightly offset towards the rear with respect to a plane common to the axes 18 and 176. In the position illustrated in FIG. 7, swivel 245 is sufficiently spaced from the upper surface 30 of support element 19 such that, during the joint rotation of linkage element 49 and latching element 79 in direction 53 around axis 18 with respect to ski 1, within the limits corresponding to the normal practice of cross-country skiing, swivel 245 does not abut against surface 30.

In a complementary fashion, front end 206 of boot 205 presents, in the example illustrated, the shape of a front projection 319 of sole 213 of boot 205. Projection 319 has a width extending substantially perpendicularly from median plane 3 of ski 1 between lateral surfaces 324 and 325 which are positioned as was stated above with regard to surfaces 124 and 125, of projection 119 in the first embodiment described. Projection 319 is defined, respectively, towards the top and front, with reference to the position illustrated in FIG. 7, by surfaces 340 and 339 which are at every point comparable to surfaces 140 and 139, respectively. In particular, surface 340 is provided with a groove 341 which is comparable at every point to groove 141 to serve as a support, in direction 345 which descends radially with respect to axis 247 and passes towards the rear of axis of 176 in the position illustrated in FIG. 7, to the zones of surfaces 89 and 90 of latching element 79 immediately adjacent to edge 91 in the position illustrated in FIG. 7, and to thus retain the front projection 319 of boot 205 in a nested state on swivel 245. To this end, projection 319 presents, towards the bottom, a single opening 327, which is comparable in every way to openings 127 and 128 of flaps 120 and 121 of projection 119, and presents in particular a surface 329 in the form of a quarter of a cylinder of revolution around an axis substantially coincident with axis 247 with a diameter substantially identical to that of surface 246 of swivel 245 to mate with the latter on top in the position illustrated in FIG. 7, substantially symmetrically on both sides of a vertical plane including axis 247, i.e., with respect to swivel 245. Surface 329 is identical at every point to surface 129 of openings 127 and 128 with respect to sleeves 37 and 38, respectively. Towards the front, surface 329 is connected to surface 336 which is oriented similarly to surfaces such as 136 and is itself connected towards the front and top to the surface 339. Towards the rear, surface 329 is connected, respectively on both sides of rib 12, by surfaces such as 334, oriented similarly to surfaces such as 134, and to surfaces such as 335 through which sole 213 of boot 205 rests flat on the upper surface strips 10 and 11 of ski 1 in the position illustrated in FIG. 7.

In the case of this embodiment, sleeves 37 and 38 are maintained by means of the maintenance of linkage element 49 with respect to ski 1 along a direction substantially perpendicular to longitudinal median plane 3 thereof.

One of ordinary skill in the art can easily understand the operation of the binding illustrated in FIGS. 7 and 8 from the operation of the binding illustrated in FIGS. 1–6.

Figure 9:
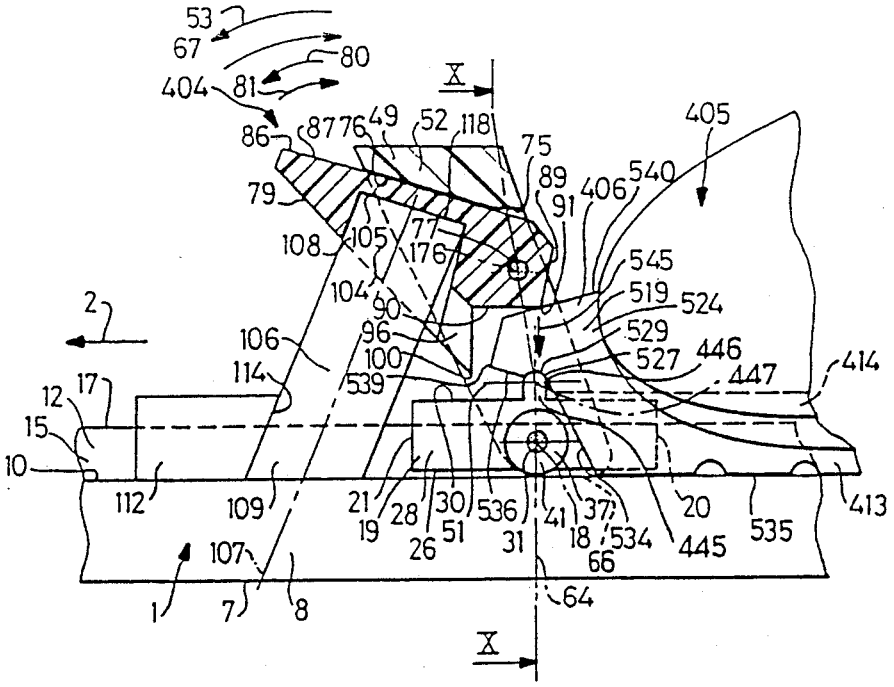
FIG. 9 illustrates, in a view analogous to that of FIGS. 3 and 7, a third embodiment of the binding according to the invention in the state in which the boot has been inserted.
Figure 10:
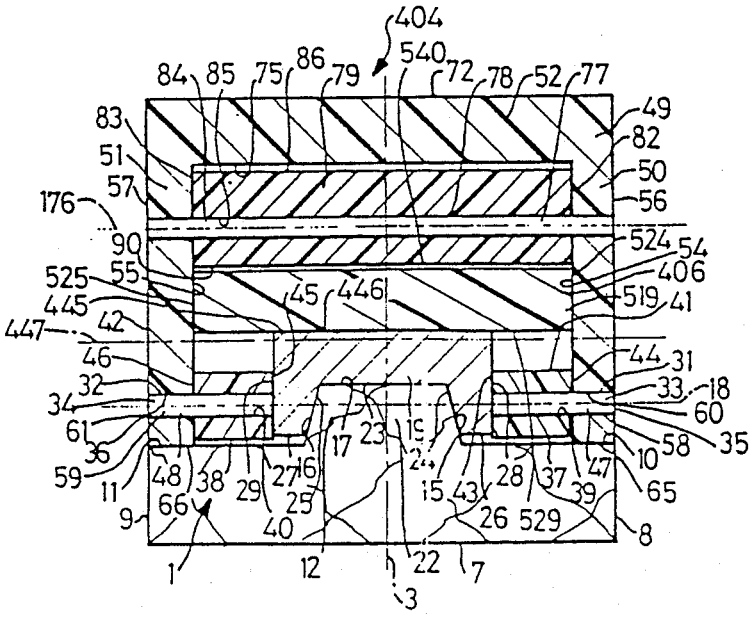
FIG. 10 illustrates a view of the binding in cross-section through planes perpendicular to the longitudinal median plane of the ski and whose outline is identified as X—X in FIG. 9.

The embodiment of the invention illustrated in FIGS. 9 and 10 corresponds to the case where the boot is journalled on the ski around an axis which is offset with respect to the journal axis of the latching element on the ski.

In this embodiment, boot 405 can be identical in every way to boot 205 described with reference to FIGS. 7 and 8, with the exception that any groove corresponding to groove such as 341, existing in the case of the embodiment of FIGS. 7 and 8, is absent in the case of this embodiment. The upper surface 540 of projection 519 forming the front end 46 of boot 405 is substantially planar and relatively smooth. In FIGS. 9 and 10, where appropriate, the same reference numerals are used as in FIGS. 7 and 8, raised by 200, to designate identical elements of boot 405.

With the difference which will be described below, binding 404 is furthermore identical to binding 4, described with reference in FIGS. 1–6, and, as can be seen in FIGS. 9 and 10, the same references are utilized as with respect to FIGS. 3 and 6, respectively, to designate the same portions of the binding.

However, in the case of this embodiment, the upper surface 30 of the support element 19 carries in an affixed manner, in an upward projection, a bump 445 which has towards the top a surface 446 which is semi-cylindrical in revolution around an axis 447 substantially parallel to the axis 18, and for example, positioned directly vertically above axis 18, even though another arrangement could likewise be selected. The surface 446 has a diameter substantially identical to that of surface 529 of projection 519 of boot 405 to serve as a support to the latter, towards the bottom, in a radial and centripetal direction with respect to axis 447 and is identified by an arrow 545 passing to the rear of axis 176 in FIG. 9. Projection 519 is rotatable around axis 447 with respect to support element 19. As seen in FIG. 10, bump 445 has a width defined in a substantially perpendicular direction with respect to longitudinal median plane 3 of ski 1 by respective extensions which are substantially coplanar extensions of surfaces 28 and 29 of support element 19. Bump 445 is defined towards the front and towards the rear, beneath the semi-cylindrical surface 446, by surfaces which do not constitute an obstacle to the extensional movements of the foot and, for example, are substantially planar, vertical, and perpendicular to longitudinal median plane 3 of ski 1.

One of ordinary skill in the art will easily understand the operation of the binding illustrated in FIGS. 9 and 10 from the description of the operation of the binding illustrated in FIGS. 1–6. It will be easily understood that the extensional movements of the foot, being translated into a joint rotation of the front end 406 of boot 405 around axis 447 with respect to support element 19 and ski 1 and of the assembly formed by linkage element 49 and latching element 79 around axis 18 with respect to support element 19 and ski 1, such extensional movements of the foot being translated into sliding movements of edge 91 between surfaces 89 and 90 of latching element 79 on an upper surface 540 of projection 519 with, however, maintenance of edge 91 resting on surface 540 and, as a result, maintenance of projection 519 resting, in the direction of 545, on bump 445, under the effect of the elastically compressible element 106.

Of course, the three embodiments of the inventions which have been described and illustrated constitute only non-limiting examples with respect to which one can provide numerous other embodiments. The variations can relate in particular to the mode of attachment of the binding with the ski, the support element 19 and the support shoe 112 being able to form an integral portion of ski 1 or to be replaced by other elements fulfilling the same functions, and particularly by zones of ski 1 which are appropriately shaped for this purpose.

Although the invention has been described with reference to particular means, materials and embodiments, it is to be understood that the invention is not limited to the particulars disclosed and extends to all equivalents within the scope of the claims.

What is claimed is:

1. A cross-country binding adapted to assure the linkage between a front portion of a cross-country ski boot and a cross-country ski comprising:

at least one support element;

a linkage element swivel-mounted on said at least one support element around a first axis including a means for limiting rotation of said linkage element in a predetermined direction around said first axis with respect to said at least one support element in a manner so as to define a preferred angular position of said linkage element with respect to said at least one support element, said predetermined direction being oriented from front to rear above said first axis;

a latching element swivel-mounted on said linkage element around a second transverse axis between, respectively, a retention position and a release position with respect to a front portion of said ski boot, movement from said release position to said retention position occurring by rotation of said latching element in said predetermined direction around said second axis with respect to said linking element, said predetermined direction being oriented from front to rear above said second axis;

at least one journal surface extending around a third axis for supporting said front portion of said ski boot, with respect to said at least one support element and/or said linkage element by supporting said front portion of said ski boot, with respect to said at least one support element, and/or said linkage element in a radial direction with respect to said third axis, said at least one journal surface facing upwardly;

at least one support zone of said latching element for supporting in said retention position, said front portion of said ski boot opposite said third axis with respect to said front portion of said ski boot in said radial direction, said at least one support zone of said latching element being offset with respect to said second axis and facing in said predetermined direction and being positioned such that it likewise faces in said radial direction in said retention position and is removed from said front portion of said ski boot opposite said radial direction and in said release position; and means for elastically biasing both of said latching element and said linkage element in said predetermined direction;

wherein said elastically biasing means comprises at least one element which is elastically compressible and is supported in compression on a zone of said at least one support element, offset with respect to said first axis and is supported on a portion of said latching element, offset with respect to said second axis.

2. A binding according to claim 1 wherein said at least one support zone of said latching element is positioned rearwardly of a geometrical plane through said second and third axes in said retention position.

3. A binding according to claim 1 wherein said at least one journal surface is convex for cooperation with a concave surface of said front portion of said ski boot.

4. A binding according to claim 1 wherein said zone of said at least one support element is situated in front of said first axis and in that said portion of said latching element is positioned in front of said second axis when said linkage element occupies said preferred angular position and said latching element occupies said retention position.

5. A binding according to claim 1 wherein said latching element and said linkage element comprise stopping means for limiting rotation of said latching element in said predetermined direction around said second axis, with respect to said linkage element in a manner so as to define a limiting angular position of said latching element with respect to said linkage element, said limiting angular position being close to said retention position, but offset towards said predetermined direction.

6. A binding according to claim 1 wherein said latching element and said linkage element comprise stopping means for limiting rotation of said latching element in said predetermined direction, around said second axis, with respect to said linkage element in a manner so as to define a limiting angular position of said latching element with respect to said linkage element, said limiting angular position corresponding to said retention position.

7. A binding according to claim 1 wherein said latching element has a surface for voluntary application of pressure in a direction opposite to said predetermined direction, said pressure application surface facing upwardly with reference to said predetermined direction and upwardly when said linkage element occupies said preferred angular position and said latching element occupies said retention position.

8. A binding according to claim 1 wherein said latching element comprises at least one zone for biasing said front portion of said ski boot in a direction opposite to said predetermined direction during movement from said retention position to said release position.

9. A binding according to claim 1 wherein said latching element comprises two wings spaced along said first axis and said second axis such that said front portion of said ski boot can be inserted between said wings and in that said latching element can be positioned between said wings.

10. A binding according to claim 1 wherein said first axis and said third axis are substantially coincident.

11. A binding according to claim 1 wherein said third axis is offset with respect to said first axis and with respect to said at least one support element.

12. A binding according to claim 1 wherein said third axis is offset with respect to said first axis and fixed with respect to said linkage element.

13. A binding according to claim 10 wherein said at least one support zone of said latching element is a convex projection for cooperation with a transverse concave seat of said front portion of said boot.

14. A binding according to claim 11 wherein said at least one support zone of said latching element is a convex projection for cooperation with a transverse concave seat of said front portion of said boot.

15. A binding according to claim 10 wherein said at least one support zone of said latching element is a transverse edge for cooperation with said front portion of said ski boot.

16. A binding according to claim 11 wherein said at least one support zone of said latching element is a transverse edge for cooperation with said front portion of said ski boot.

17. A binding according to claim 12 wherein said at least one support zone of said latching element is a transverse edge for cooperation with said front portion of said ski boot.

18. A binding according to claim 1 wherein said support element is at least partially constituted by said ski.

19. A ski binding comprising:

a linkage element for pivotal mounting relative to a ski about a first axis;

a latching element pivotally connected to said linkage element about a second axis between a retention position, for retaining a boot to said binding, and a release position, for permitting said boot to be removed from said binding;

means separate from said latching element for supporting at least a portion of said boot when said latching element is in said retention position, said means for supporting comprising a journal surface extending around a predetermined axis and for supporting said ski boot for rotation about said predetermined axis when said ski boot is mounted to said binding;

means for biasing said latching element toward said retention position, said means for biasing being supported by means fixed with respect to said means for supporting at least a portion of said boot and by said latching element.

20. The ski binding of claim 19 wherein, during operation of said binding, said means for biasing said latching element is elastically compressible along a predetermined direction offset from said first axis and from said second axis.

21. The ski binding of claim 19 wherein, when said binding is mounted upon a ski, said means for biasing said latching element is supported by said means for supporting at least a portion of said boot forwardly of said first axis, and is supported by said latching element forwardly of said second axis.

22. The ski binding of claim 19 further comprising means for limiting linkage element from rotation rearwardly beyond a preferred position.

23. The ski binding of claim 22 wherein said means for limiting rotation of said linkage element is carried by said linkage element.

24. The ski binding of claim 22 wherein said means for biasing said latching element further biases said linkage element toward said preferred position.

25. The ski binding of claim 19 wherein said latching element is the only element of said ski binding that is movably connected directly to and offset from said linkage element said first axis.

26. The ski binding of claim 19 wherein said first axis and said predetermined axis are substantially coextensive.

27. The ski binding of claim 19 wherein said predetermined axis is not coextensive with said first axis and wherein said journal surface is carried by said linkage element.

28. The ski binding of claim 19 wherein said predetermined axis is not coextensive with said first axis and wherein said journal surface is adapted to be fixed relative to said ski.

29. The ski binding of claim 19 wherein said latching element comprises a support zone opposite said journal surface for supporting said portion of said boot, wherein said support zone is rearward of a plane passing through said second axis and said predetermined axis.

30. The ski binding of claim 29 wherein said support zone is a generally convex surface for cooperation with a generally concave surface on said portion of said boot.

31. The binding of claim 19 wherein said linkage element and said latching element comprise respective surfaces for limiting rotation of said latching element in a rearward direction about said second axis to thereby define a limiting angular position of said latching element with respect to said linkage element.

32. The ski binding of claim 19 wherein said latching element comprises a surface for applying a force to said latching element for movement of said latching element to said release position.

33. The ski binding of claim 19 wherein said latching element comprises a portion for exerting a rearward force against said portion of said boot during movement of said latching element from said retention position to said release position.

34. The ski binding of claim 19 wherein said linking element comprises a pair of spaced apart wings and said latching element is connected between said pair of wings, whereby said portion of said boot is adapted to be inserted between said pair of wings in said retention position of said latching element.

35. The ski binding of claim 19 wherein said means for supporting at least a portion of said boot comprises a portion of said ski.

36. The ski binding of claim 19 wherein said means for supporting at least a portion of said boot comprises a support element to which said linkage element is pivotally mounted.

37. The ski binding of claim 36 wherein said support element has a longitudinal concavity for mating with an upwardly projecting longitudinal ski rib.

38. The ski binding of claim 19 wherein said means for supporting at least a portion of said boot also comprises means for mounting said linkage element for pivoting around said first axis, and said means for biasing is connected to said latching element and to means fixed relative to said means for mounting said linkage element.

39. A ski binding comprising:

a linkage element for pivotal mounting relative to a ski about a first axis, said linkage element comprising a pair of wings;

a latching element pivotally connected to said linkage element about a second axis between a retention position, for retaining a boot to said binding, and a release position, for permitting said boot to be removed from said binding;

means separate from said latching element for supporting at least a portion of said boot when said latching element is in said retention position, said means for supporting comprising a support element to which said linkage element is pivotally mounted, said means for supporting comprising a pair of swivels extending between a respective wing of said linkage element and a lateral side of said support element, said support element further having a longitudinal concavity for mating with an upwardly projecting longitudinal ski rib;

means for biasing said latching element toward said retention position, said means for biasing being supported by means fixed with respect to said means for supporting at least a portion of said boot and by said latching element.

40. The ski binding of claim 39 further comprising a respective sleeve surrounding each of said swivels for providing a support surface for said portion of said boot.

41. The ski binding of claim 39 wherein said support element further comprises an upwardly projecting bump for providing a support surface for said portion of said boot.

* * * * *

UNITED STATES PATENT AND TRADEMARK OFFICE

CERTIFICATE OF CORRECTION

PATENT NO. : 4,925,206

DATED : May 15, 1990

INVENTOR(S) : Gerard GRAILLAT

It is certified that error appears in the above-identified patent and that said Letters Patent is hereby corrected as shown below:

Column 1, line 6, change "a" to ---in---.
Column 2, line 24, change "as so" to ---so as---.
Column 6, line 7, change "When" to ---when---.
Column 6, line 29, change "axis" to ---axes---.
Column 8, line 50, change "verticallY" to ---vertically---.
Column 9, line 30, delete "a" after "to".
Column 9, line 31, change "surface" to ---surfaces---.
Column 9, line 31, change "is" to ---are---.
Column 9, line 57, change "or" to ---of---.
Column 10, line 29, change "31" to ---18---.
Column 11, line 50, change "surfaces" to ---surface---.
Column 11, line 68, insert ---.--- after "18".
Column 12, line 28, change "or" to ---of---.
Column 13, line 11, change "surfaces" to ---surface---.
Column 13, line 12, change "a" to ---an---.
Column 14, line 24, change "Which" to ---which---.
Column 14, line 48, insert ---FIGS.--- after "in".
Column 14, line 50, change "195" to ---105---.
Column 15, line 10, change "110" to ---106---.
Column 15, line 33, change "cf" to ---of---.
Column 15, line 35, change "and" to ---end---.
Column 18, line 22, delete "of" after "median".
Column 19, line 4, change "19" to ---119---.
Column 20, line 21, change "axis" to ---axes---.
Column 20, line 50, change "147" to ---247---.
Column 21, line 8, delete "of" after "axis".
Column 21, line 56, change "46" to ---406---.
Column 22, line 9, delete "and centripetal".

UNITED STATES PATENT AND TRADEMARK OFFICE

CERTIFICATE OF CORRECTION

PATENT NO. : 4,925,206

DATED : May 15, 1990

INVENTOR(S) : Gerard GRAILLAT

It is certified that error appears in the above-identified patent and that said Letters Patent is hereby corrected as shown below:

Column 22, line 41, change "inventions" to ---invention---.

Column 23, line 32, in claim 1, line 44, delete "and" after "direction.

Column 23, line 53, in claim 4, line 3, delete "of".

Column 25, line 33, in claim 25, line 4, insert "and" after "element".

Column 26, line 6, in claim 34, line 1, change "linking" to ---linkage---.

Signed and Sealed this

Thirtieth Day of June, 1992

*Attest:*

DOUGLAS B. COMER

*Attesting Officer*

*Acting Commissioner of Patents and Trademarks*